US005970865A

United States Patent [19]

Horth et al.

[11] Patent Number: 5,970,865

[45] Date of Patent: Oct. 26, 1999

[54] APPARATUS AND METHOD FOR PRINTING MULTI-COLOR IMAGES ONTO CYLINDRICAL BODY

[75] Inventors: Roland Horth, Blacksburg, Va.; Karl Fleischer, Denver; Paul Choate, Aurora, both of Colo.; Craig Whipple, Ledyard, Conn.

[73] Assignee: Mitsubishi Materials Corporation, Tokyo, Japan

[21] Appl. No.: 09/026,920

[22] Filed: Feb. 20, 1998

Related U.S. Application Data

[60] Provisional application No. 60/040,887, Feb. 26, 1997.

[51] Int. Cl.[6] ..... B41F 17/22

[52] U.S. Cl. ..... 101/40; 101/490

[58] Field of Search ..... 101/35, 38.1, 39, 101/40, 40.1

[56] References Cited

U.S. PATENT DOCUMENTS

| | | | |
|---|---|---|---|
| 2,796,164 | 6/1957 | Hakogi | 101/40 |
| 3,356,019 | 12/1967 | Zurick | 101/39 |
| 3,548,745 | 12/1970 | Sirvet et al. | 101/40 |
| 3,851,579 | 12/1974 | Zurick | 101/39 |
| 3,960,073 | 6/1976 | Rush | 101/40 |
| 3,996,851 | 12/1976 | Urban | 101/40 |
| 4,140,053 | 2/1979 | Skrypek et al. | 101/40 |
| 4,337,719 | 7/1982 | Vander Griendt et al. | 101/40.1 |
| 4,370,943 | 2/1983 | Watanabe et al. | 101/40 |

FOREIGN PATENT DOCUMENTS 5-96704 4/1993 Japan .

*Primary Examiner*—Edgar Burr
*Assistant Examiner*—Leslie J. Grohusky
*Attorney, Agent, or Firm*—Oblon, Spivak, McClelland, Maier & Neustadt, P.C.

[57] ABSTRACT

An apparatus and method for printing multi-color images onto a cylindrical body includes ink adhesion mechanisms that adhere different colors of ink to an outer peripheral surface of the cylindrical body. Ink drying mechanisms are included for drying the different colored inks adhered to the cylindrical body after the completion of the respective ink adhesion processes. Each of the ink adhesion mechanisms is arranged such that a mandrel, about which the cylindrical body is held, is moved in an arc along the outer periphery of a cylinder-shaped blanket which is disposed around the outer peripheral surface of an blanket cylinder. Ink is applied to the cylindrical body from the blanket at a position where the cylindrical body contacts the blanket. The blanket cylinder is rotated about an axis thereof in the direction opposite to the moving direction of the mandrel. The mandrel is rotated about an axis thereof so that a relative velocity of the cylindrical body and the blanket at the contact portion is zero. With this arrangement, multi-color images of high quality can be printed onto the cylindrical body at a high velocity with pinpoint accuracy.

13 Claims, 9 Drawing Sheets

APPARATUS AND METHOD FOR PRINTING MULTI-COLOR IMAGES ONTO CYLINDRICAL BODY

CROSS-REFERENCE TO RELATED APPLICATION

The present document claims priority to provisional patent application entitled "Apparatus for Printing Multi-Color Images Onto a Cylindrical Body," filed Feb. 26, 1997, Ser. No. 60/040,887, the entire contents of which is incorporated herein by reference.

BACKGROUND OF THE INVENTION

1. Field of the Invention

The present invention relates to an apparatus and a method for printing, and more particularly, to printing multi-color images onto cylindrical portions such as "can bodies" of so-called two-piece cans and the like. More specifically, the present invention relates to a multi-color printing apparatus and a multi-color printing method capable of easily conveying out multi-color printing onto vessels, such as beverage cans, which permit a wide variety of fine colorings by overlapping images at a high velocity.

2. Discussion of Background

Offset flexographic printing apparatuses have been used as conventional printing apparatuses for decorating the can body of two-piece cans and the like. Essentially, all the colors applied to the can body, so as to create distinctive decorations or images thereon, are applied by a single ink transfer blanket. Then, the can makes one complete revolution with respect to the ink transfer blanket to achieve perfect decoration, as intended.

The respective colors for defining an entire image are positioned before they are applied to the surface of the can body. The ink applied to the ink transfer blanket is wet ink, where wet ink of one color is located adjacent to wet ink of a second color. This may result in phenomena known in the can decoration industry as "back trapping," where one ink color runs into the adjacent color. As a result, the resolution of the ink, or quality of graphics decoration, is inherently limited with the conventional offset flexographic printing process.

There is also known a multi-color printing apparatus composed of a plurality of ink transfer blanket cylinders arranged in a seriatim (serial) array and a can carrier that is moved to position cans at successive printing stations where the blanket cylinders are located. At the printing stations, the blanket cylinders and the cans are rotated while they are in contact with each other so as to transfer ink onto the cans. Different ink colors are used at each of a plurality of printing stations to provide multi-color image printing on cans in diverse and highly artistic patterns.

In the above multi-color printing apparatus, the cans can be moved on a carrier by the use of a transport belt where the blanket array is in a linear arrangement.

A coating unit can be used following ink printing to overlay a finish coat such as a varnish onto the printed image. In the apparatus, each blanket is located at an associated printing station and each printing station includes an associated source for supplying ink to the blanket. Further, there is also provided at least one ink dryer.

The carrier is movable so as to sequentially position the subject can at successive printing stations and cause the can to come into contact with the ink transfer blanket so that the ink is applied to the outer surface of the can. In addition, the ink drier is located so as to dry the ink, applied to the can at a printing station, before the can is positioned at the next printing station.

As recognized by the present inventors, the above described conventional printing apparatus and method still have the following problems. Generally, it is desired to shorten the entire printing process time because the inks of the respective colors must be individually dried to prevent the aforementioned back trapping, and thus, a long time is needed to finish the printing of all the colors. It is also desirable to maintain the accurate alignment of the can body throughout a plurality of individually located ink printing stations and ink curing or drying stations interposed between the respective stations to correctly print the respective colors. Further, as appreciated by the present inventors, it is desirable to print a photograph or a complex image having an image quality comparable to a photograph whose printing has been conventionally difficult.

SUMMARY OF THE INVENTION

Accordingly, one object of this invention is to provide a novel method and system for printing multi-colored images on bodies that overcomes the above-mentioned limitations of existing methods and systems.

Another object of the present invention, made in view of the above-identified problems, is to provide a multi-color printing apparatus and a multi-color printing method for executing multi-color printing of high quality onto cylindrical bodies with pinpoint accuracy and at a high velocity.

These and other objects may be accomplished with a device and method described below. A multi-color printing method for printing on a cylindrical body according to a first aspect of the present invention employs a plurality of ink adhesion processes for adhering different colors of inks onto outer peripheral surfaces of cylindrical bodies, respectively, a plurality of ink drying processes is also employed for drying the inks adhered onto the cylindrical bodies after the completion of the respective ink adhesion processes. In this method each of the ink adhesion processes is executed such that mandrels which hold the cylindrical bodies by inserting them externally thereof are moved in an arc along the outer peripheries of blankets which are disposed at the outer peripheral surfaces of blanket cylinders and to which the inks are applied in a state such that the outer peripheral surfaces of the cylindrical bodies are made to contact the outer peripheral surfaces of the blankets when the blanket cylinders are rotated about their axes in the direction opposite to the moving direction of the mandrels. The mandrels are rotated about their axes so as to make the relative velocity be zero of the portions where the cylindrical bodies are in contact with the blankets.

A multi-color printing apparatus for printing on a cylindrical body according to a second aspect of the present invention employs a plurality of ink adhesion mechanisms for adhering different ink colors on the outer peripheral surfaces of cylindrical bodies, respectively. A cylindrical body moving mechanism is included for successively moving the cylindrical bodies held by thereby to the plurality of ink adhesion mechanisms. A plurality of ink drying mechanisms are disposed in the vicinities of the plurality of ink adhesion mechanisms, respectively, for drying the inks adhered onto the cylindrical bodies. Each of the ink adhesion mechanisms includes a blanket cylinder and a blanket disposed around the outer periphery of the blanket cylinder for transferring one of the inks applied thereto onto a cylindrical body by causing the outer peripheral surface thereof to come into contact with the outer peripheral surface of the cylindrical body. The cylindrical body moving mechanism includes mandrels each having an axis parallel with the axis of the blanket and holds the cylindrical body by inserting it externally thereto. Mandrel moving mechanisms are each configured to move a mandrel in an arc along the outer periphery of the blanket so that the outer periphery of the cylindrical body held by the mandrel is in contact with the outer periphery of the blanket. Rotation control mechanisms each rotate the blanket cylinder about its axis in the direction opposite to the moving direction of the mandrel as well as rotating the mandrel about its axis so that the relative velocity at the portion where the cylindrical body is in contact with the blanket is made to be zero.

In the multi-color printing apparatus and method described above, since the mandrels are moved in an arc along the outer peripheries of the blankets when the blanket cylinders are rotated about their axes in the direction opposite to the moving direction of the mandrels, the entire peripheries of the cylindrical bodies come into contact with the blankets in a short time. As a result, the time necessary to transfer the inks can be greatly shortened as compared to devices and methods where inks are transferred at a fixed position without the movement of the mandrels even if the blankets have the same rotational velocity.

Further, since the mandrel is rotated by being positively controlled so that the relative velocity of the portion where the cylindrical body comes into contact with the blanket is made to be zero, the portion of the cylindrical body in contact with the blanket is not dislocated in the transfer of the ink and the ink can be precisely adhered onto the outer peripheral surface of the cylindrical body with pinpoint accuracy, even if the mandrel carries out the arc motion.

A multi-color printing apparatus according to a third aspect of the present invention employs a cylindrical body moving mechanism with a wheel having the plurality of mandrels disposed along the outer periphery thereof. A wheel driving mechanism rotates the wheel about its axis. A plurality of ink adhesion mechanisms have the blanket cylinders and the blankets disposed around the wheel at equal intervals in the peripheral direction thereof in parallel with the axis of the wheel and the wheel driving mechanism rotates the wheel to thereby successively move the mandrels to the positions where the mandrels confront the blanket cylinders in the rotating direction thereof in the multi-color printing apparatus as discussed with respect to the second aspect of the present invention.

According to the third aspect of the present invention, since the wheel having the plurality of mandrels disposed around the outer periphery thereof at equal intervals is rotated and the mandrels are successively moved to positions where they confront the blanket cylinders in the rotational direction thereof, the plurality of cylindrical bodies can be moved and the inks can be adhered onto them and dried simultaneously with the movement thereof. Also, the cylindrical bodies can be easily positioned and respective colors can be successively printed.

A multi-color printing apparatus according to a fourth aspect of the present invention employs rotation control mechanisms having a mandrel side gear fixed to the shaft of the mandrel coaxially with the axis thereof and a blanket side gear fixed to the shalt of the blanket cylinder coaxially with the axis thereof. Accordingly, when the mandrel moves in an arc along the outer periphery of the blanket, the mandrel side gear is coupled with the blanket side gear in the multi-color printing apparatus for cylindrical body according to the second or third aspects of the present invention. Since the mandrel side gears are coupled with the blanket side gears when the mandrels move in an arc along the outer peripheries of the blankets, the mandrels and the blankets rotate in association with each other, whereby the mandrels can certainly and precisely rotate on the blankets.

A multi-color printing apparatus according to a fifth aspect of the present invention employs each of the rotation control mechanism having positioning mechanisms, for causing the position where the outer peripheral surface of a mandrel comes into contact with that of an ink transfer blanket cylinder for the first time to be unchanged with respect to the plurality of ink adhesion mechanisms at all times in the multi-color printing apparatus for cylindrical body according to the fourth aspect of the present invention.

According to this fifth aspect of the present invention, since the rotation control mechanism is provided with the positioning mechanisms for causing the position where the outer peripheral surface of a mandrel comes into contact with that of a blanket for the first time to be unchanged with respect to the plurality of ink adhesion mechanisms at all times, the outer peripheral surface of the mandrel and that of the blanket are always positioned with respect to each ink adhesion mechanism and ink begins to be adhered from a specific position, whereby a plurality of inks are correctly transferred onto the cylindrical body.

A multi-color printing apparatus according to a sixth aspect of the present invention employs the positioning mechanisms having an intermediate gear disposed in between adjacent ones of the ink adhesion mechanisms and coupled with the blanket sidle gear of each ink adhesion mechanism. The mandrel side gear is coupled so as to rotate and move while maintaining the engaging state between the blanket side gear and the intermediate gear in the multi-color printing apparatus for cylindrical body according to the fifth aspect of the present invention.

According to the sixth aspect, since the positioning mechanisms include the intermediate gear disposed in between adjacent ones of the ink adhesion mechanisms and coupled with the blanket side gear of each ink adhesion mechanism, and the mandrel side gear is coupled so as to rotate and move while remaining engaged between the blanket side gear and the intermediate gear, the mandrel can be certainly transferred onto a next blanket cylinder without being dislocated.

A multi-color printing apparatus according to a seventh aspect of the present invention employs each of the ink drying mechanisms such that they dry the ink of the cylindrical body held by the mandrel of the mandrel side gear when the mandrel side gear is coupled with the intermediate gear in the multi-color printing apparatus for cylindrical body according to the fifth aspect of the present invention.

According to the seventh aspect, since the ink drying mechanisms are disposed between the blanket cylinders, respectively, and the ink of a cylindrical body held by the mandrel of a mandrel side gear is dried when the mandrel side gear is coupled with an intermediate gear, the drying process can be simultaneously carried out while the cylindrical body is transferred to a next cylindrical body. Also, since the mandrel is rotated by the mandrel side gear engaged with the intermediate gear even while the mandrel is transferred, the ink can be easily dried over the entire periphery of the cylindrical body being held.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
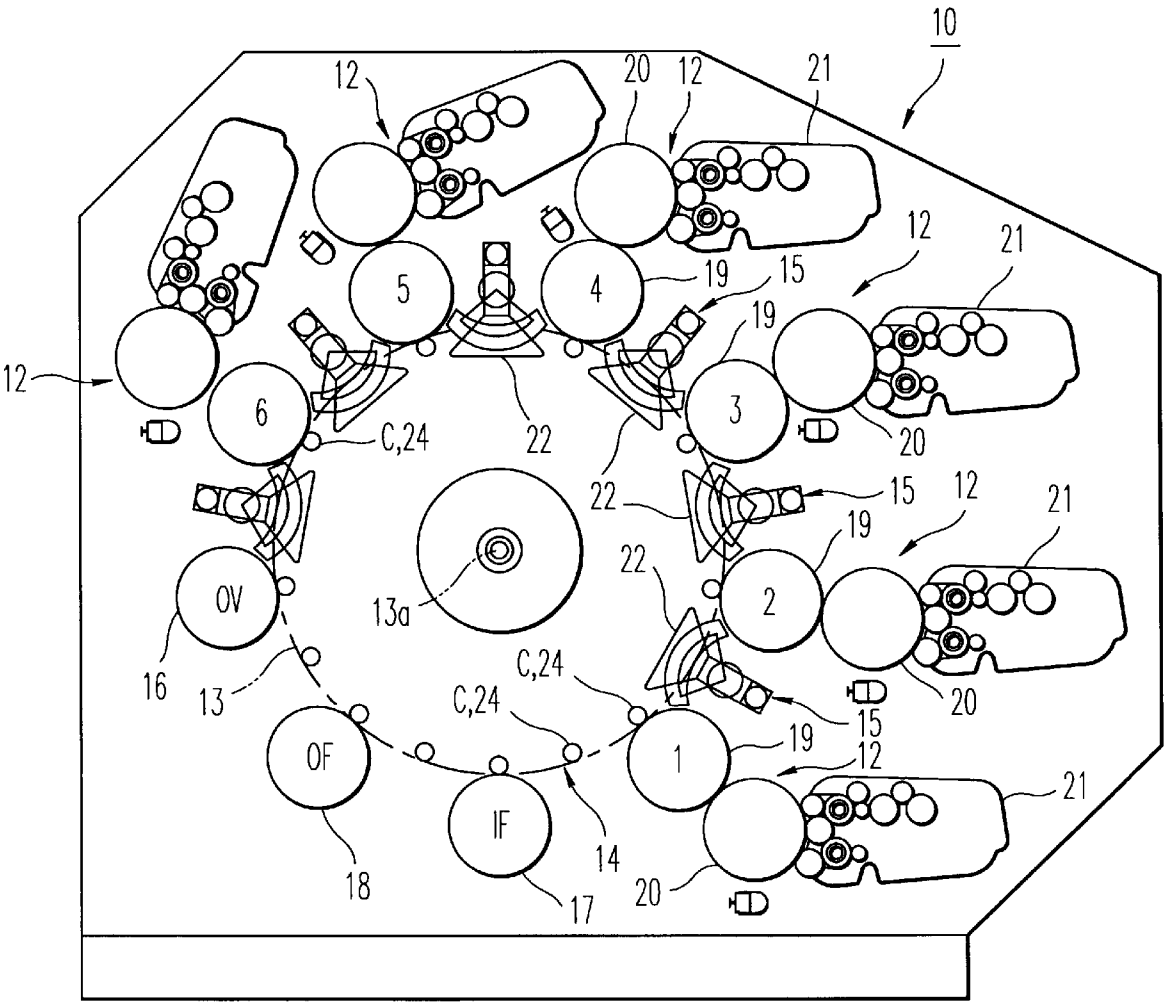
FIG. 1 is a schematic side elevational view showing an embodiment of a multi-color printing apparatus for printing on a cylindrical body according to the present invention.

Referring now to the drawings, wherein like reference numerals designate identical or corresponding parts throughout the several views, and more particularly to FIGS. 1–9 thereof, there is illustrated a multi-color printing apparatus for printing on a cylindrical body according to the present invention. In these figures, symbol C denotes a can body, numeral 10 denotes a multi-color printing apparatus, numeral 11 denotes a main body housing, numeral 12 denotes printing stations, numeral 13 denotes a star wheel, numeral 14 denotes a can body moving mechanism and numeral 15 denotes drying stations.

The multi-color printing apparatus 10 is an apparatus for effecting multi-color printing on a cylindrical body, in particular, the can body C of a type used to manufacture a two-piece beverage can. The two-piece cans to which the printing is applied are mainly aluminum although they are sometimes fabricated from steel. Further, other types of cylindrical vessels such as those composed of plastic, paper, etc. may be also processed by the apparatus of the present invention. The application of printing or graphics onto the can body C is typically called the "decoration" of the can in the industry.

As shown in FIG. 1, the multi-color printing apparatus 10 is arranged such that the main body housing 11, having support mechanisms for supporting various components, accommodates the plurality of printing stations (ink adhesion mechanisms) 12 for adhering different colors onto the outer peripheral surface of can body C (cylindrical body), respectively. A can body moving mechanism (cylindrical body moving mechanism) 14 is included for successively transferring the can body C to the plurality of printing stations 12, while holding it by a star wheel 13, which is rotated about its axis 13*a*, and the plurality of drying stations (ink drying means) 15 disposed in the vicinity of the plurality of printing stations 12, respectively for drying the ink adhered to the can body C.

The multi-color printing apparatus 10 is further provided with a varnish overcoat station 16 for applying a varnish onto the can body to which all the colors have been applied at the plurality of printing stations 12. An infeed station 17 is included for supplying the can body C prior to printing into the apparatus, as is an outfeed station 18 for discharging the can body C to which the varnish has been applied to a next process, performed external to the apparatus, and these components are supported by the main body housing 11, respectively.

The printing stations 12, the infeed station 17 and the outfeed station 18 are disposed at equal intervals in a peripheral direction in the vicinity of the outer periphery of the star wheel 13, respectively. The respective drying stations 15 are disposed in the vicinity of the star wheel 13 adjacent to the respective printing stations 12 on the rotational direction side of the star wheel 13.

The plurality of printing stations 12 transfer different colors of inks and are identified by Nos. 1 to 6. The respective printing stations 12 are arranged substantially similarly to each other and disposed in such a way that when the can body C is carried counterclockwise from the infeed station 17 to the outfeed station 18, through the multi-color printing apparatus 10, the can body C successively confronts the respective printing stations 12.

Each of the printing stations 12 includes a cylindrical (cylindrical-shaped or column-shaped) ink transfer blanket cylinder 19 which is rotatable about an axis 19*a*, a print cylinder 20 which is disposed so as to be in contact with the outer peripheral surface of the ink transfer section (blanket) 50 and rotatable about an axis parallel with the axis 19*a* of the ink transfer blanket cylinder 19 and an ink source 21 for applying a predetermined amount of ink onto the outer peripheral surface of the print cylinder 20. The ink transfer blanket cylinder 19 has an ink transfer section (blanket) 50 formed around the outer peripheral surface thereof. An ink pattern is previously deposited onto the outer peripheral surface thereof and transferred onto the outer peripheral surface of the rotating can body C by causing the outer peripheral surface of the ink transfer section 50 to come into contact with the can body C.

The print cylinder 20 registers at least a portion of an image or decoration applied to the can body C, depending on a color of the ink. The ink sources 21 ordinarily supply different colors of inks at the respective printing stations 12 and various metering rollers, transfer rollers, oscillating bridge rollers and the like are interposed between each of the ink sources 21 and the print cylinder 20 in physical association with each other.

Using the apparatus in a multi-color printing process, each color of ink is applied to a selected substrate (e.g., the can body C) and thereafter cured or dried. Because the ink which has been applied to the substrate is dried before the next color of ink is applied, the color of ink applied at each succeeding station can be applied over, so as to overlap, previously applied colors. The result is an almost infinite number of possibilities in the use of shades and colors for very complex decorations.

The drying stations 15 include ink dryers 22 disposed adjacent to the plurality of printing stations 12. The dryers 22 may be, for example, ultraviolet-radiation irradiating devices, electron beam, thermal drying units or the like. The ink dryer 22 is selected in accordance with the type of ink selected for application to the substrate (can body C).

As should be readily appreciated, the application of the individual colors at each of the plurality of discrete printing stations 12 requires that the substrate (can body C) be located at a precise position relative to the ink transfer blanket cylinder 19 when it arrives at each station. Failure to establish and maintain this positional relationship will render an unacceptable product characterized by colors which are not aligned and improperly overlapped. Thus, the embodiment precisely carries out the movement and alignment of the can body C by the can body moving mechanism 14, described below.

Figure 2:
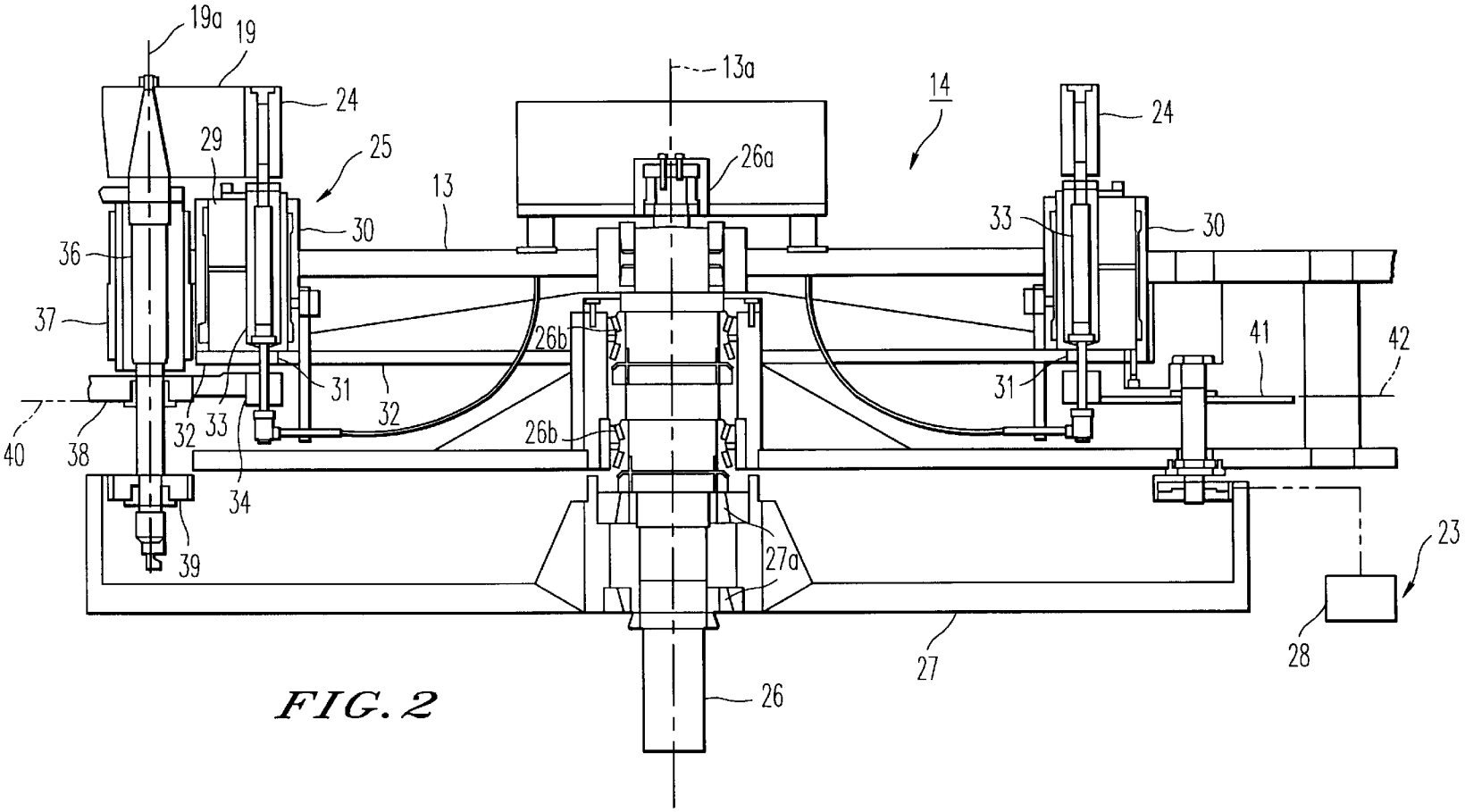
FIG. 2 is a sectional view showing the positional relationship of a wheel shaft, a blanket cylinder shaft, a mandrel shaft and the like in the embodiment of the multi-color printing apparatus for printing on a cylindrical body according to the present invention.
Figure 3:
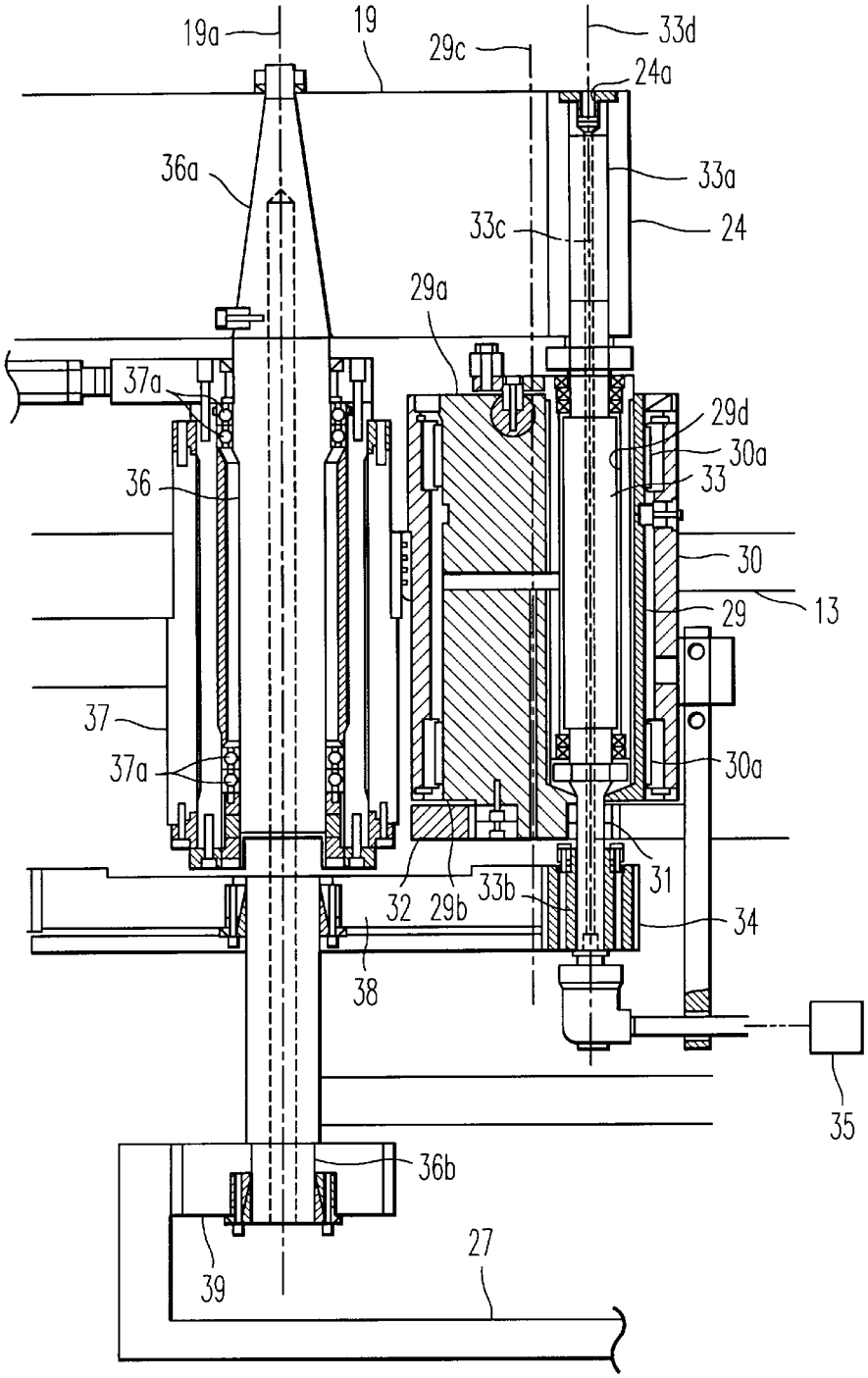
FIG. 3 is a sectional view of the main portion of a mandrel housing and the like in the embodiment of the multi-color printing apparatus for printing on a cylindrical body according to the present invention.
Figure 4:
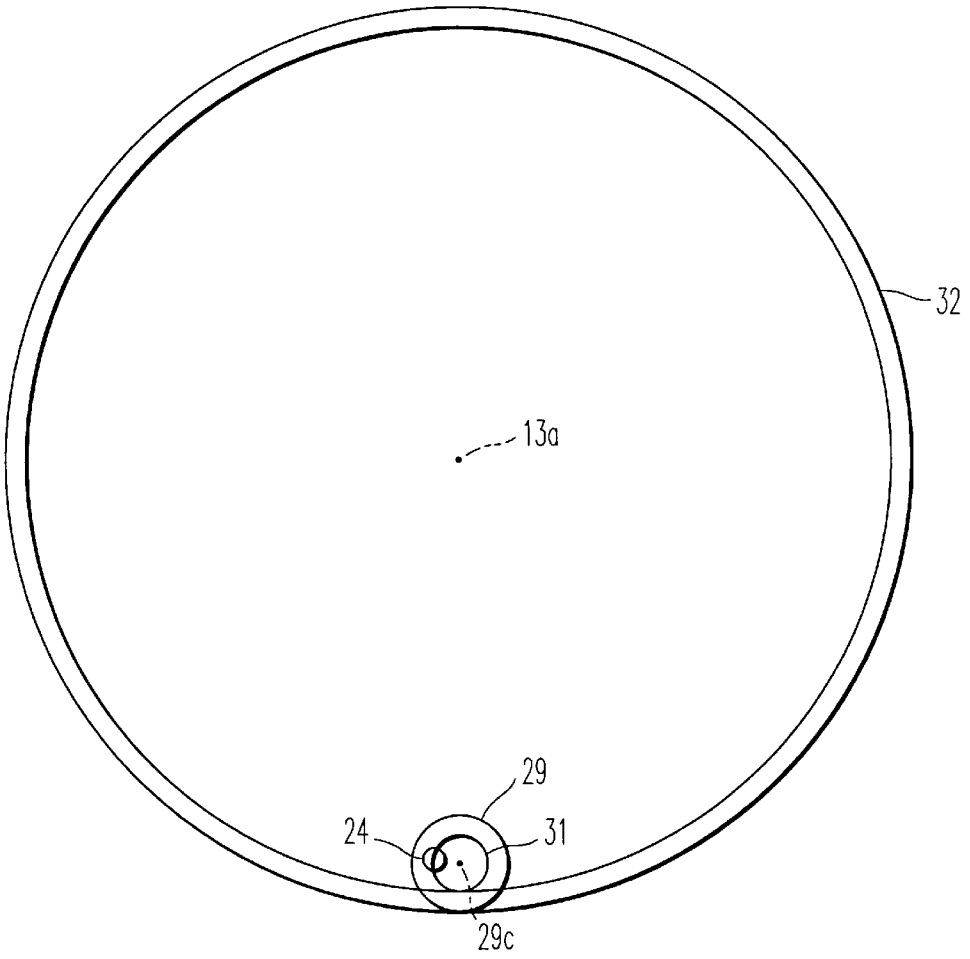
FIG. 4 is a schematic front elevational view showing the positional relationship between a mandrel housing and a star wheel in the embodiment of the multi-color printing apparatus for printing on a cylindrical body according to the present invention.
Figure 5:
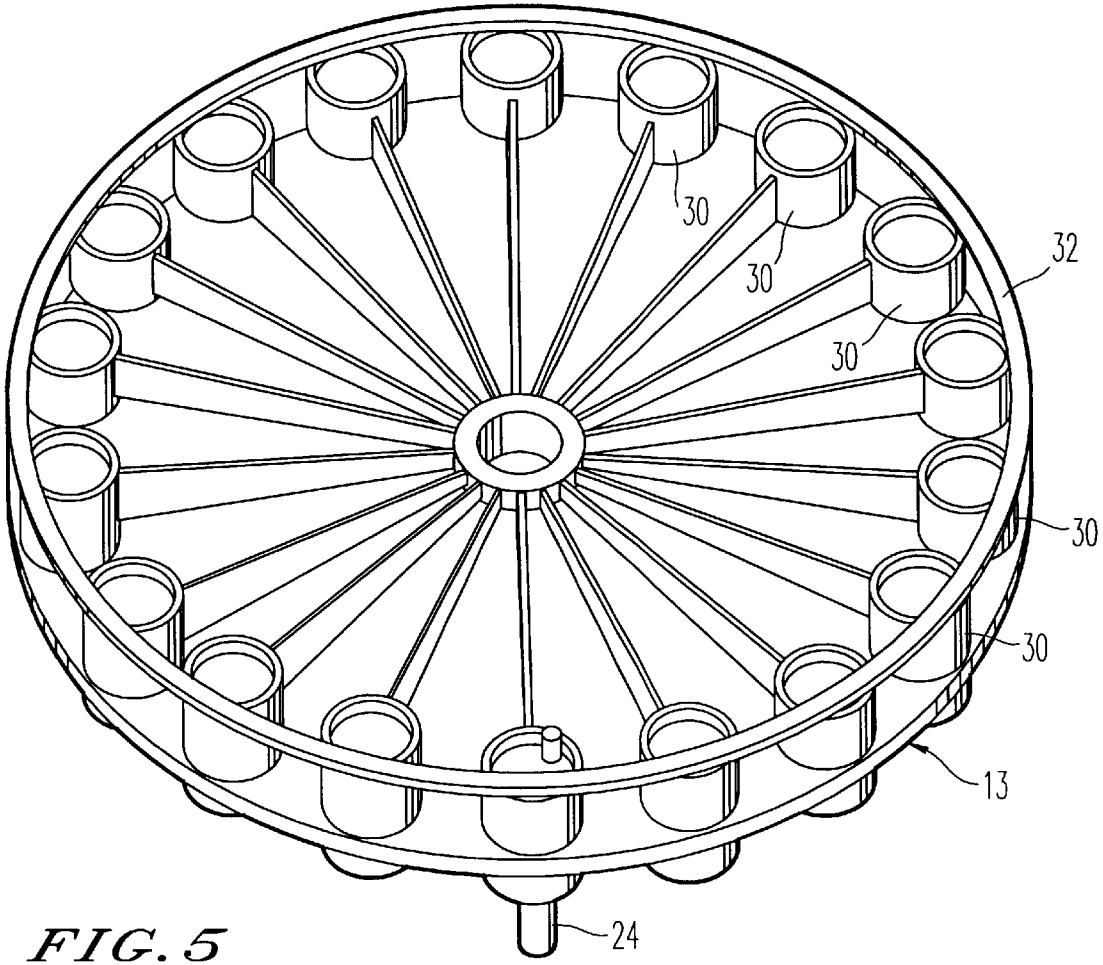
FIG. 5 is schematic perspective view of the star wheel having a multiplicity of housing stations in the embodiment of the multi-color printing apparatus for printing on a cylindrical body according to the present invention.
Figure 6:
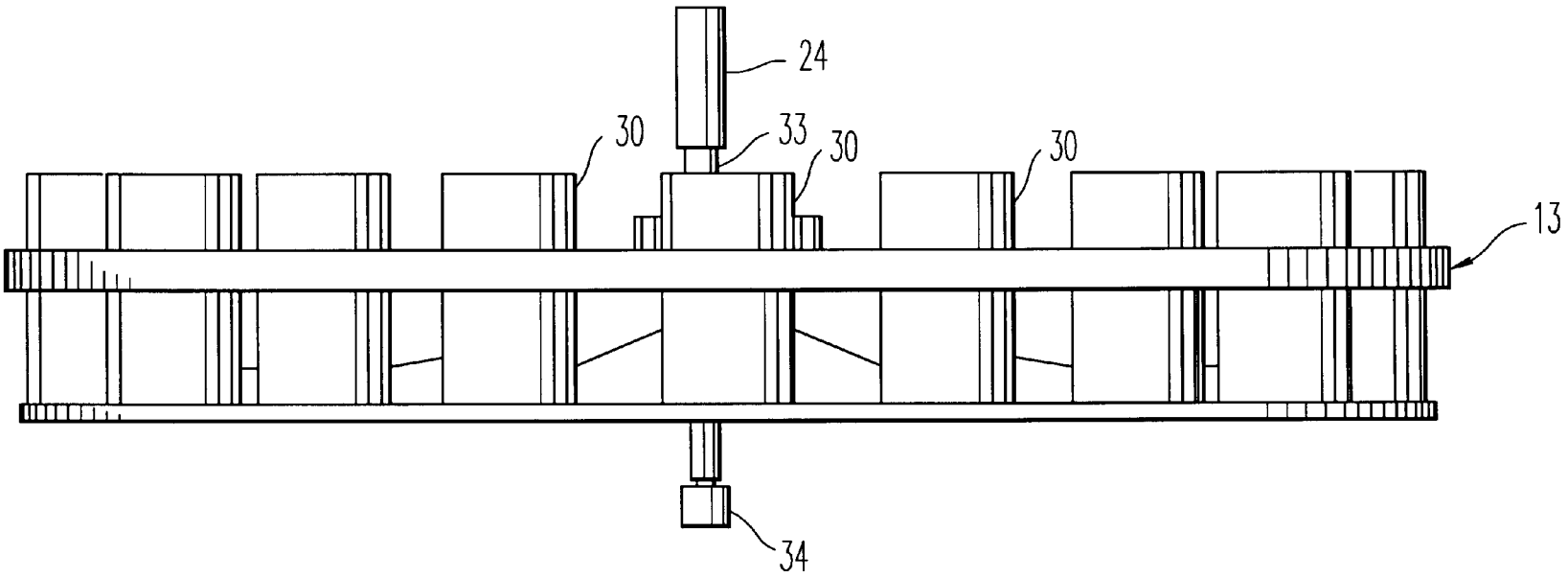
FIG. 6 is a schematic side elevational view of the star wheel having the multiplicity of housing stations in the embodiment of the multi-color printing apparatus for printing on a cylindrical body according to the present invention.

The can body moving mechanism 14 includes a wheel driving mechanism 23 for rotating the star wheel 13 about the axis 13*a*, a plurality of mandrels 24 which are disposed around the outer periphery of the star wheel 13 at equal intervals in parallel with the axis 1 3*a* of the star wheel 13 and hold the can bodies C inserted externally thereon and a mandrel moving mechanism 25 for moving the mandrels 24 in an arc along the outer periphery of the ink transfer blanket cylinders 19 such that the outer peripheral surfaces of the can bodies C held by the mandrels 24 contact the outer peripheral surfaces of the ink transfer section (blanket) 50. As seen in FIG. 2, the star wheel 13 is fixed to the extreme end of a wheel shaft 26 by a fixing member 26*a* and the wheel shaft 26 is rotatably supported by the main body housing 11 through bearings 26*b*. The star wheel 13 is named after the ultimate motion applied to the mandrels 24 mounted thereon as described below. The star wheel 13 rotates about the axis 13*a* counterclockwise. A bull gear 27 is coaxially fixed to the wheel shaft 26 at the rear end thereof by fixing members 27*a* and supported by the wheel shaft 26 by being inserted externally thereon.

As will be described later, the rotational direction of the star wheel 13 will govern the rotational direction of the various other components of the multi-color printing apparatus 10. The counterclockwise rotation of the star wheel 13 ensures that a minimum of one can C rotation takes place as the can C passes through the ink transfer section (blanket) 50 in contact therewith.

The wheel driving mechanism 23 has a motive mechanism 28 such as a motor or the like which is mechanically coupled with the star wheel 13 and the star wheel 13 is rotated about the axis 13*a* by the motive means 28. The motive mechanism 28 is also coupled with the bull gear 27 to thereby rotate the bull gear 27 and the star wheel 13.

The mandrel moving mechanism 25 has a plurality of mandrel housing, 29 which are mounted to the outer periphery of star wheel 13 at equal intervals in the peripheral direction thereof. The mandrel housings 29, each formed into a cylindrical structure having a front surface 29*a* and a rear surface 29*b*, are supported in a cylindrical housing station 30 fixed to the outer periphery of the star wheel 13 so as to be rotatable about axes 29*c* through a plurality of bearing means 30*a*. A planetary gear 31 which is coaxial with the axis 29*c* is fixed to the rear surface 29*a* of each of the mandrel housings 29. In the preferred embodiment, the star wheel 13 supports eighteen mandrel housings 29 disposed symmetrically on the outer periphery thereof.

The main body housing 11 supports a fixed internal ring gear 32 which is disposed in parallel with the star wheel 13 and has the axis 13*a* coaxial with the star wheel shaft 26. The fixed internal ring gear 32 is mechanically coupled with the mandrel housings 29 by being meshed with the teeth of the planetary gear 31 thereof. Thus, the rotational motion of the star wheel 13 results in the relative motion between the meshed gear teeth of the planetary gear 31 and the fixed internal ring gear 32. Further, the relative motion between the planetary gear 31 and the fixed internal ring gear 32 results in the rotation of the mandrel housing 29 about the axis 29*c* within the housing station 30 while the mandrel housing 29 orbits the axis 13*a* of the star wheel 13.

The mandrel housing 29 has an inner peripheral surface 29*d* whose axis is parallel with, and eccentric to, the axis 29*c* and a mandrel shaft 33 is rotatably inserted into the inner peripheral surface 29*d*. The mandrel shaft 33 has the cylindrical mandrel 24 fixed to the extreme end 33*a* thereof as well as a mandrel side gear 34 fixed to the rear end 33*b* thereof. The mandrel shaft 33 has a through hole 33*c* formed in the interior thereof and the through hole 33*c* is coupled with a suction mechanism 35 at the rear end 33*b* of mandrel shaft 33. The suction mechanism 35 is connected a vacuum pump or the like, as well as The through hole 33*c* is connected to an adsorbing port 24*a* formed to the extreme end of the mandrel 24 at the extreme end 33*a* of the mandrel shaft 33. More specifically, the can body C inserted externally on the mandrel 24 is fixed thereto through the adsorbing port 24*a* which is connected to the suction mechanism 35 through the through hole 33*c*.

Each of the ink transfer blanket cylinders 19 is fixed to and mounted on the extreme end 36*a* of a blanket cylinder shaft 36 disposed in parallel with the axis 13*a* of the star wheel 13 and the blanket cylinder shaft 36 is supported by the main body housing 11 as well as inserted into a cylindrical shaft support member 37 and rotatably supported by bearings 37*a*. The blanket cylinder shaft 36 has a primary gear (blanket side gear) 38 which is fixed coaxially therewith at the portion thereof located on the rear end side of the shaft support member 37 as well as a coupling gear 39 fixed coaxially therewith at the rear end 36*b* thereof.

The coupling gear 39 is meshed with the bull gear 27 and the rotation of the bull gear 27 imparts a rotational motion to the ink transfer blanket cylinder 19. Therefore, the respective ink transfer blanket cylinders 19 are rotated at a specific similar velocity by a comprehensive gear system which is connected to the common bull gear 27. The bull gear 27 is mounted to rotate about the wheel shaft 26. The motive mechanism 28 is mechanically coupled with the bull gear 27 to thereby impart a rotational motion to the bull gear 27 and the star wheel 13. Therefore, the bull gear 27 is rotated in the same direction as that of the star wheel 13.

Since the primary gear 38 and the coupling gear 39 are also provided with the varnish overcoat station 16, the outfeed station 18 and the infeed station 17 likewise, each nine sets, are disposed including those provided with the respective ink transfer blanket cylinders 19 of the six printing stations 12. These nine primary gears 38 are mounted so that they are rotated on a common plane which is a plane 40 parallel with the star wheel 13.

Figure 7:
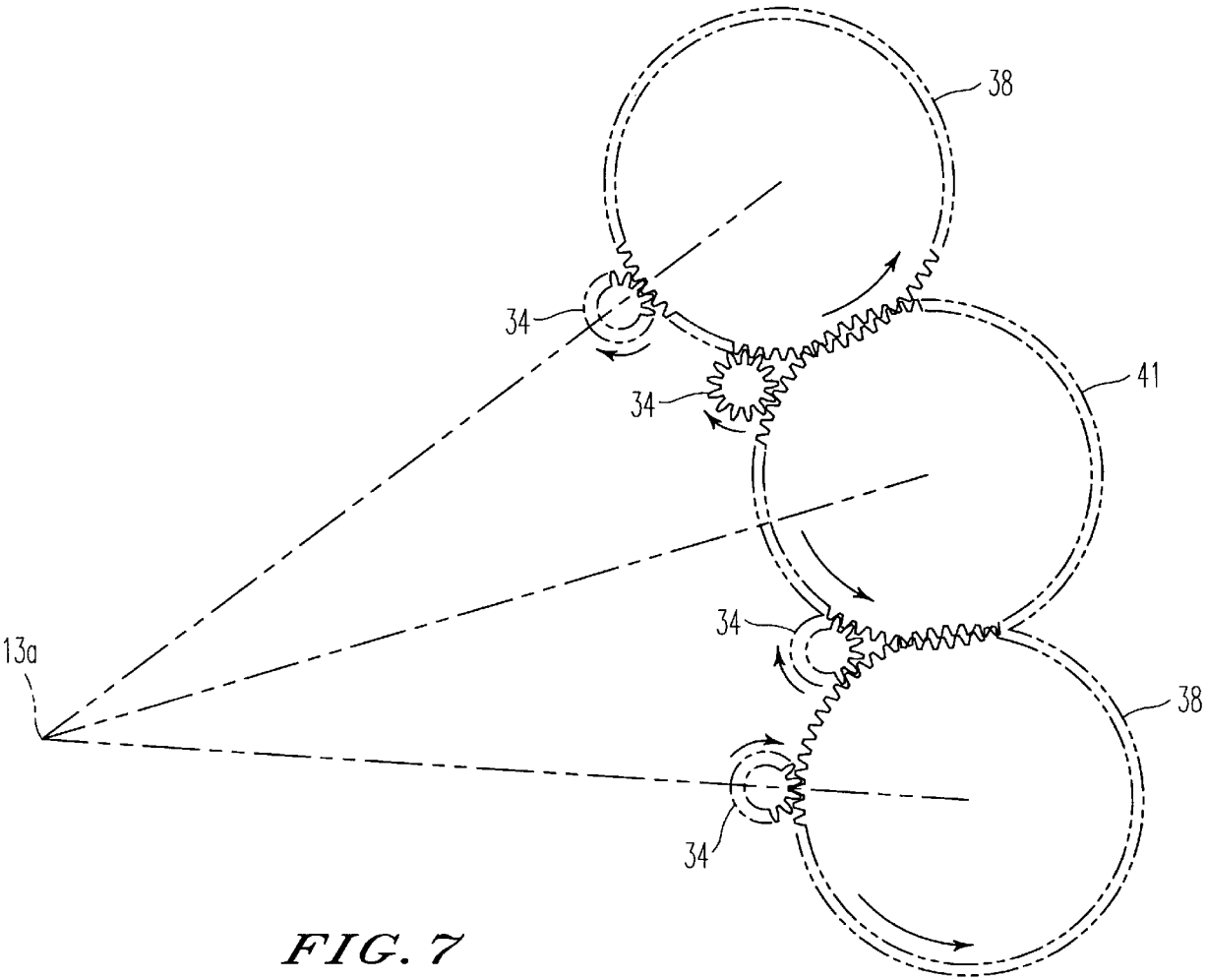
FIG. 7 is a schematic view showing a gear system composed of a mandrel side gear, a primary gear and a secondary gear associated with the mandrel housing in the embodiment of the multi-color printing apparatus for printing on a cylindrical body according to the present invention.

As shown in FIG. 2 and FIG. 7, nine secondary gears (intermediate gears) 41 are interposed between each of the nine primary gears 38 along the plane 40. The secondary gears 41 have a gear pitch radius which is identical to that of the primary gears and are driven by the bull gear 27 in the same manner as the primary gears 38, and therefore, in the same counterclockwise direction. One of the secondary gears 41 may be in communication with the motive means 28 in order to drive the bull gear 27, and thus the entire bull gear system. However, because the primary gears 38 and the secondary gears 41 are rotated in two distinct planes 40 and 42, respectively, adjacent gears are positioned without being in contact with each other in such a manner that their teeth partially overlap when viewed from an axial direction. This is schematically shown in FIG. 7 wherein the teeth of adjacent gear members (the primary gear 38 and the secondary gear 41) appear to overlap.

As described above, the bull gear 27, the coupling gears 39, the primary gears 38, the mandrel side gears 34, the planetary gears 31, the fixed internal ring gear 32 and the secondary gears 41, which are in association with the motive mechanism 28 by being mechanically coupled therewith, rotate the ink transfer blanket cylinders 19 in the direction opposite to the moving direction of the mandrels 24 as well as rotate the mandrels 24 so that the relative velocity of the portion where the can body C come into contact with the ink transfer section (blanket) 50 is made to be zero. More specifically, these gears act as a rotation control mechanism for controlling the rotation of the star wheel 13, the ink transfer blanket cylinders 19, the mandrels 24 and the like.

Can Body Introduction Process

A multi-color print method applied by the multi-color printing apparatus 10 to the can body C will now be described. First, a can body C conveyed from a previous process is mounted by the infeed station 17 on a mandrel 24 located at the position confronting the infeed station 17 and transferred on the outer periphery of the star wheel 13. Thereafter, the star wheel 13 is rotated counterclockwise by the motive mechanism 28 so as to convey the mandrel 24 holding the can body C to No. 1 printing station 12. More specifically, the can body C held by the mandrels 24 is transferred to a specific position where the can body C confronts and comes into contact with the ink transfer section (blanket) 50 of the printing stations 12 and ink transfer operation starts.

Ink Adhesion Process

Next, the mandrel 24 which holds the can body C by inserting it externally thereof is moved in an arc along the outer periphery of the ink transfer blanket cylinder 19 in the state that the outer peripheral surface of the can body C is in contact with the outer peripheral surface of the ink transfer section (blanket) 50 to which ink is applied.

More specifically, when the bull gear 27 is rotated by the motive mechanism 28, the ink transfer blanket cylinder 19 coupled with the bull gear 27 through the coupling gear 39 is rotated at a specific rotational velocity. The mandrel 24 is also coupled with the ink transfer blanket cylinder 19 through the primary gear 38 and the mandrel side gear 34 is also rotated at a specific rotational velocity. As the star wheel 13 rotates, the mandrel housing 29 moves in the direction opposite to the rotational direction of the ink transfer blanket cylinder 19, and thus the mandrel housing 29 coupled with the fixed internal ring gear 32 through the planetary gear 31 is rotated.

At the same time, since the mandrel shaft 33 in the mandrel housing 29 is disposed eccentrically with respect to the axis 29*c* of the mandrel housing 29, the mandrel 24 is rotated about the axis 29*c* of the mandrel housing 29 and the mandrel housing 29 is moved by the rotation of the star wheel 13. As a result, the mandrel 24 is moved along the outer periphery of the ink transfer blanket cylinder 19 by an arc-shaped orbital motion imparted thereto. More specifically, the locus drawn by the mandrel 24 is composed of a plurality of arc-shaped loci and every other arc-shaped locus substantially agrees with a portion of the outer periphery of the respective ink transfer section (blanket) 50 cylinders 19 disposed on the circumference of a circle.

As described above, the orbital motion of the mandrel 24 relating to the mandrel housing 29 and the star wheel 13 is cycloidal. More importantly, a reason for naming the star wheel 13 which such a distinctive name is that the cycloidal motion of the mandrel 24 traces the imaginary outline of a multi-pointed star as the star wheel 13 rotates about the axis 13*a*. More specifically, the motion that the mandrel 24 traces can be generally understood to be hypotrochoidal.

The pitch radius of the planetary gear 31 defines a variable "a" while the pitch radius of the fixed internal ring gear 32 as measured from the axis 13*a* of the star wheel 13 defines a variable "c". The distance from the axis 29*c* of the mandrel housing 29 to the axis 33*d* of the mandrel shaft 33 defines a second variable "b". The definition of the cycloidal induced star-like motion of the mandrel 24 is effected by the relationship of the variables "a" and "b". For example, as the value of "b" approaches the value of "a", the cusps of the star-like motion will become more pointed. If the value of "b" is greater than the value of "a", the cusps of the star-like motion will become loops. It is clear, in light of the present description, that as the value of "b" approaches zero, the eccentric motion is minimized and will ultimately be eliminated.

Although the mandrel housing 29 is fixedly positioned to the star wheel 13, it is traveling at a constant velocity with respect to the rotating ink transfer blanket cylinders 19. As described above, the rotation of each mandrel housing 29 causes the eccentrically mounted mandrel 24 to make an orbital motion while rotating about the axis 29*c* of the mandrel housing 29.

As described above, the eccentric motion of the mandrel 24 is an arc about the arcuate surface of the ink transfer section (blanket) 50 and necessary in order to convey the can body C mounted on the mandrel 24. However, while this orbital motion is at a constant velocity, the translational motion of the mandrel 24 with respect to the ink transfer blanket cylinders 19 is occurring at a continuously changing velocity due to the arcuate motion of the mandrel 24. Therefore, it is critical to coordinate the relative motion of the mandrel 24 with respect to the ink transfer blanket cylinder 19.

More specifically, in order to transfer the ink from an ink transfer section (blanket) 50 which is rotating at a constant velocity to a can body C supported on the mandrel 24 which is moving with respect to the ink transfer blanket cylinder 19, the controlled rotational motion of the mandrel 24 about the axis 33*d* of the mandrel shaft 33 is additionally necessary. To this end, the outer peripheral surface of the can body C which is in contact with the outer peripheral surface of the ink transfer section (blanket) 50 does not move with respect to that of the ink transfer section (blanket) 50, that is, the relative velocity of both the outer peripheral surfaces is set to zero, as described above.

Consequently, when the outer peripheral surface of the can body C is in contact with the outer peripheral surface of the ink transfer section (blanket) 50, both the outer peripheral surfaces are moving at the identical velocity. This additional rotational motion of the mandrel 24 will be hereinafter referred to as the "secondary motion" of this system. As described above, the secondary motion in the embodiment results in a system in which the surface velocity of the can body C mounted on the rotating mandrel 24 is at the same as the surface velocity of the ink transfer section (blanket) 50.

Ink Drying Process

The can body C, whose entire peripheral surface is adhered with the ink at the printing station 12, is transferred to a drying station 15 adjacent to the printing station 12 and subjected to dry processing. More specifically, the can body C is conveyed to the position where it confronts the ink dryer 22 of the drying station 15 and at least one rotation of the can body C permits the ink to be cured or dried over the entire peripheral surface thereof. The ink adhesion process and the ink drying process are sequentially carried out at the respective printing stations 12 and drying stations 15 which are disposed counterclockwise as the can body C is moved by the rotation of the star wheel 13.

Thus, different color inks can be printed onto the can body C to thereby create a wide variety of decorations.

Station-To-Station Transfer Process

When the can body C moves through the above ink adhesion processes, it is more important to the implementation of the multi-color printing that the relative position of the can body C, when it is conveyed from station to station, is predetermined or registered. In other words, the printing process at each station starts at a predetermined fixed position on the outer peripheral surface of the can body C. Therefore, the successive printing stations 12 can deposit different color inks onto the outer peripheral surface of the can body C in various patterns to create extremely complex images.

For explanation purpose only, it is assumed that the star wheel 13 is not rotated during the rotation of the bull gear 27. Thus, although the mandrel side gears 34 rotate when the primary gears 38 and the secondary gears 41 are rotated, the star wheel 13 does not rotate and as a result the mandrel side gears 34 are located at fixed positions with respect to the multicolor printing apparatus 10 because the star wheel 13 does not rotate. Next, the mandrels 24 are rotated in the mandrel housing 29 by the rotation of the mandrel side gears 34.

On the contrary, when the bull gear 27 is not rotated during the rotation of the star wheel 13, although the mandrels 24 are translated from station to station and rotated, they are not rotated at a proper rotational velocity for printing. The rotation of the mandrel 24 must be additionally controlled to establish or maintain a desired relationship between the rotation of the can body C mounted on the mandrel 24 and the ink transfer blanket cylinder 19 in rotation, that is, the same surface velocity when the can body C is in contact with the ink transfer section (blanket) 50. For this purpose, the aforementioned two motion s cooperate with each other, as described below, to achieve the desired relationship between the outer peripheral surface of the can body C and that of the ink transfer blanket cylinder 19.

When the star wheel 13 starts rotation, that is, when it conveys the mandrel housings 29 from station to station, each mandrel side gear 34 must move between each primary gear 38 and each secondary gear 41. This can be achieved by providing the mandrel side gear 34 with a surface width which is sufficient to permit the mandrel side gear 34 to lie on the width which is delimited by the plane 40 and the plane 42 on which the primary gear 38 and the secondary gear 41 are placed.

As shown in FIG. 7, the mandrel side gear 34 is always in contact with at least one tooth of the primary gear 38 or the secondary gear 41. Essentially, while the mandrel side gear 34 moves from a gear disposed backward to a gear disposed forward, a part of the width of the mandrel side gear 34 begins to be engaged with the gear disposed forward, whereas the opposite side of the gear begins to be released from the gear disposed backward. At the time, the mandrel 24 rotates continuously. The teeth of the mandrel side gear 34 can be made to such a structure that permits the gear 34 to move between the primary gear 38 and the secondary gear 41 in smooth contact therewith. The counterclockwise motion of the primary gear 38 and the secondary gear 41 imparts a clockwise motion to the mandrel side gear 34, namely, to the can body C mounted on the mandrel 24. It is found that the counterclockwise motion of the star wheel 13 provides the primary motion of the mandrel housing 29, namely, the mandrel 24 from station to station.

The eccentric rotation of the mandrel 24 with respect to the axis 29*c* of the mandrel housing 29 causes the mandrel 24 to move from a first position at the end of the outer peripheral surface of the ink transfer section (blanket) 50 to a second position where the outer peripheral surface of the can body C is caused to come into contact with the ink transfer blanket cylinder 19 while the star wheel 13 rotates.

Finally, the can body C mounted on the mandrel 24 is rotated so that the outer peripheral surface thereof is rotated at the desired velocity by the combination of the effect of rotation of the primary gear 38 and the secondary gear on the mandrel side gear 34 and the primary motion on the mandrel housing 29 associated with the above rotation. The desired velocity is equal to the surface velocity of the ink transfer section (blanket) 50 as described above.

The gear ratio among the mandrel side gear 34, the primary gear 38 and the secondary gear 41 is set to a specific value so that the orientation and accurate overlap of the can body C is maintained throughout an entire decoration process when the can body C is mounted on the mandrel 24. That is, the gear ratio is equal to the ratio between the diameter of the outer peripheral surface of the can body C to be decorated and the diameter of the ink applying outer peripheral surface of the ink transfer section (blanket) 50.

In the embodiment, positioning means that a first ink is applied to the can body C at the first printing station 12 (station No. 1). The "positioning" of the can body C is established with respect to the entire decoration process (at the following second to sixth stations) by the disposition of the first ink or a color pattern. The positioning must be maintained to achieve the precise application of the inks onto the outer peripheral surface of the can body C at the successive stations.

Further operation of the apparatus of the present invention will be described with reference to FIG. 8 and FIG. 9 which schematically show printing on the outer peripheral surface of the can body C at a printing station 12 where single color printing is carried out.

To permit a perfect image to be applied to the outer peripheral surface of can body C, the entire components of two motions are combined. More specifically, the two motions are the rotation of the can body C itself about its axis and the translation motion of the mandrel 24 within an arc (arc having an almost constant radius) near to a circle about the axis of the ink transfer blanket cylinder 19. These two motions are carried out in cooperation with each other to obtain the surface contact length of the ink transfer blanket cylinder 19, which is equal to the circumference of the cylindrical body, namely, the outer peripheral surface of the can body C. The contact between the outer peripheral surface of the ink transfer section (blanket) 50 and that of the can body C must be maintained over the sufficient stroke distance of the mandrel 24 with respect to the ink transfer blanket cylinder 19. In the embodiment, the rotation angle of about 8 degrees of the star wheel 13 permits the perfect image to be applied onto the outer peripheral surface of the can body C.

Figure 8:
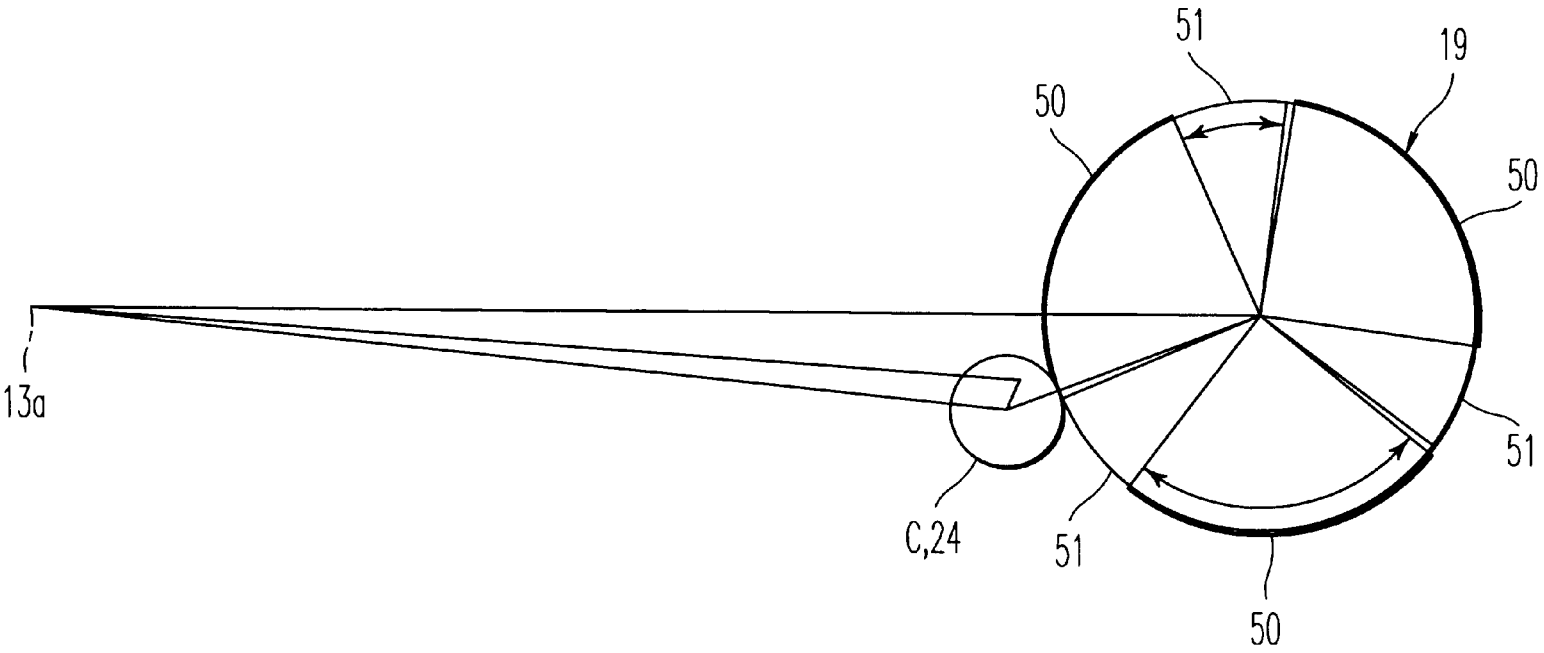
FIG. 8 is a schematic view showing the positional relationship between the mandrel and the ink transfer blanket cylinder in an ink adhesion process at the beginning of printing in the embodiment of the multi-color printing apparatus for printing on a cylindrical body according to the present invention.
Figure 9:
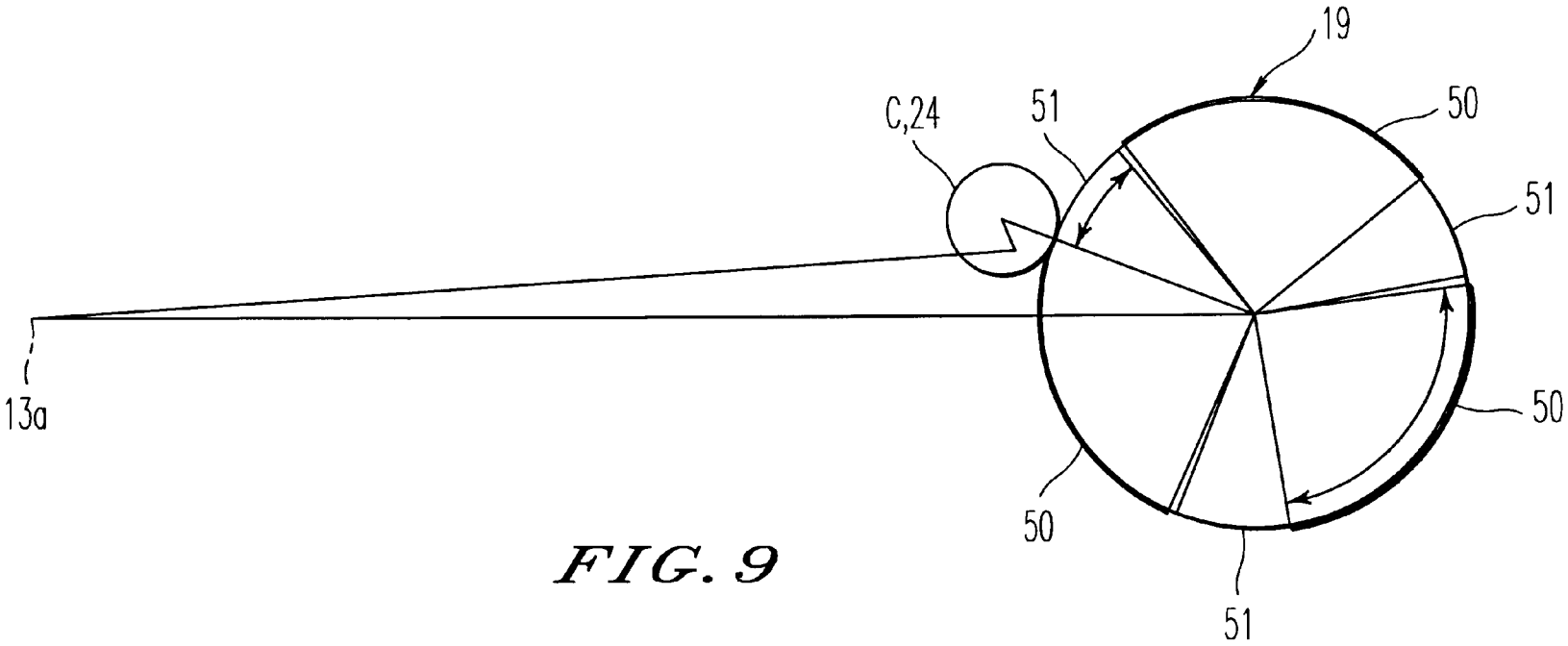
FIG. 9 is a schematic view showing the positional relationship between the mandrel and the ink transfer blanket cylinder in the ink adhesion process at the end of printing in the embodiment of the multi-color printing apparatus for printing on a cylindrical body according to the present invention.

As shown in FIG. 8, it is preferable that a specific diameter is set to the ink transfer blanket cylinder 19 so that ink transfer sections 50, where ink is applied, are provided as three ink transfer sections. In the embodiment, each ink transfer section 50 occupies a central angle of about 88 degrees. While the can body C is decorated by a portion of the ink transfer section (blanket) 50, a portion of the ink transfer section (blanket) 50 or ink transfer blanket cylinder opposite to the above portion comes into contact with the print cylinder 20 for the next application of ink.

To entirely decorate the outer peripheral surface of the can body C, the can body C must be rotated at least 360 degrees (by the combination of the rotational motion of the mandrel 24, the translation motion from the star wheel 13 and the rotation of the ink transfer blanket cylinder 19). That is, it goes without saying, that a failure to complete the full 360 degree rotation of the can body C will result in undecorated stripe or band extending axially along the length of the can body C.

It is conceived to be advantageous to cause the outer peripheral surface of the can body C to be in contact with a non-ink bearing section 51 of the ink transfer blanket cylinder 19 where no ink is applied before the can body C comes into contact with an ink transfer section 50. There are provided three non-ink bearing sections 51 in the vicinity of or forward of the ink transfer sections 50, as shown.

The can body C when rotating first comes into contact with a non-ink bearing section 51 and thereafter smoothly moves to an ink transfer section 50. It is thought that the contact with the non-ink bearing section dampens any dynamic effects resulting from the initial contact between the mandrel 24 and the ink transfer blanket cylinder 19. The rotation of the mandrel 24 is continued throughout the rotation thereof around the entire circumference of the star wheel 13. This is particularly advantageous to the multi-color printing. As described above, the respective inks are dried or cured after they are applied to the outer peripheral surface of the can body C. The rotating mandrel 24 carries the can body C past an ink dryer 22, rotationally exposing the complete surface of the can body C to the drier.

Varnish Overcoat Process

The can body C onto which all the inks have been applied throughout the plurality of printing stations 12 and drying stations 15 is conveyed to the varnish overcoat station 16. At the varnish overcoat station 15 the can body C has applied about an entire peripheral surface thereof a varnish.

Next Process Transfer Process

The can body C onto which varnish has been over-coated reaches the outfeed station 18 in the state that it is supported by the mandrel 24. The decorated can body C is removed from the mandrel 24 and carried out from the multi-color printing apparatus 10 so as to be transferred to a next process. Thereafter, the can body C having been over-coated with the varnish is ordinarily conveyed while passing through a heat treatment station. The heat treatment station is an independent system to which the can body C is supplied. Various means for mounting the can body C on the mandrel 24 and removing it therefrom are well known to persons skilled in the art.

The printing stations 12 and the varnish overcoat station 16 are provided with a sensor for sensing whether the can body C is mounted on a mandrel 24 or not. When the can body C is not mounted on the mandrel 24, a blanket is prevented from being in contact with the outer peripheral surface of the mandrel 24 so that ink or varnish is not applied thereto.

In the multi-color printing apparatus 10 and the multi-color printing method of the present invention, since the mandrel 24 is moved in an arc along the outer periphery of the ink transfer blanket cylinder 19 and, at the time, the ink transfer blanket cylinder 19 is rotated about its axis in the direction opposite to the moving direction of the mandrel 24, the entire periphery of the can body C comes into contact with the ink transfer section (blanket) 50 in a short time. Consequently, a processing time is greatly shortened for transferring ink onto the entire periphery as compared with the case that ink is transferred at a fixed position without the movement of the mandrel 24 even if the ink transfer section (blanket) 50 has the same rotational velocity.

Since the mandrel 24 is rotated by being positively controlled so that a relative velocity is made to be zero at the portion where the can body C is in contact with the ink transfer blanket cylinder 19, the ink can be precisely adhered on the outer peripheral surface of the can body C with pinpoint accuracy and without a dislocation of the portion where they are in contact with each other in the transfer of the ink even as the mandrel 24 carries out the arc motion.

Since the star wheel 13 having the plurality of mandrels 24 disposed around the outer periphery thereof at equal intervals are rotated and the mandrels 24 are successively moved to the positions where they confront the ink transfer blanket cylinders 19 in the rotational direction thereof, the plurality of can bodies C can be simultaneously moved and the inks can be adhered thereto and dried as well as the respective colors can be successively printed.

Since the mandrel side gears 34 are coupled with the primary gears 38 when the mandrels 24 move in an arc along the outer peripheries of the ink transfer blanket cylinders 19, the mandrels 24 and the ink transfer blanket cylinders 19 are rotated in association with each other, whereby the mandrel 24 can certainly and precisely rotate on the ink transfer section (blanket) 50.

Since each secondary gear 41 is located halfway between adjacent printing stations 12 as well as indirectly coupled with each primary gear 38, and a mandrel side gear 34 is coupled with the primary gear 38 and the secondary gear 41 so that it can rotate and move while maintaining the engaging state with the primary gear 38 and the secondary gear 41, the mandrel 24 can be accurately transferred onto a next ink transfer blanket cylinder 19 without being dislocated.

More specifically, the primary gear 38, the secondary gear 41 and the mandrel side gear 34 act as positioning mechanisms for positioning the mandrel 24 and the ink transfer section (blanket) 50. As a result, the position where the outer peripheral surface of the mandrel 24 comes into contact with that of the ink transfer blanket cylinder 19 for the first time is unchanged with respect to the plurality of printing stations 12 at all times.

Since the ink dryers 22 are disposed between the ink transfer blanket cylinders 19, respectively and when the secondary gears 41 are coupled with the mandrel side gears 34, the ink of the can bodies C held by the mandrels 24 of the mandrel side gears 34 are dried. The drying process is executed simultaneously with the transfer of the can bodies C to the next ink transfer blanket cylinders 19. The mandrels 24 are rotated by the mandrel side gears 34 engaged with the secondary gears 41 even while they are transferred, whereby the ink can be easily dried over the entire peripheries of the can bodies C being held.

In light of the above discussion, it is clear that the present invention can at least achieve the following advantages:

(1) According to the multi-color printing method for printing on a cylindrical body according to the first aspect of the invention and the multi-color printing apparatus according to the second aspect of the invention, since the mandrels are moved in an arc along the outer peripheries of the blankets, when the blanket cylinders are rotated about their axes in the direction opposite to the moving direction of the mandrels, the entire peripheries of the cylindrical bodies come into contact with the blankets in a short time. As a result, the time necessary to transfer the inks can be greatly shortened, the printing process can be carried out at a high velocity as a whole, and mass-productivity can be improved relative to conventional devices and methods.

Further, the mandrels are rotated by being positively controlled so that the relative velocity of the portion where the cylindrical body comes into contact with the blanket is made to be zero. Even if the mandrel carries out the arc motion, it is not dislocated, the ink can be adhered onto the outer peripheral surface of the cylindrical body and a photograph or a complex image of high quality nearing that of the photograph which are conventionally difficult can be obtained in multi-colors.

(2) According to the multi-color printing apparatus for printing on a cylindrical body according to the third aspect of the present invention, since the wheel having the plurality of mandrels disposed around the outer periphery thereof at equal intervals is rotated and the mandrels are successively moved to the positions where they confront the blanket cylinders in the rotational direction thereof, the plurality of cylindrical bodies can be moved and the inks can be adhered onto them and dried simultaneously with the movement thereof as well as the cylindrical bodies can be easily positioned and respective colors can be successively printed, whereby productivity can be more enhanced in the printing process.

(3) According to the multi-color printing apparatus for printing on a cylindrical body according to the fourth aspect of the present invention, since the mandrel side gears are coupled with the blanket side gears when the mandrels move in an arc along the outer peripheries of the blankets, the mandrels and the blankets rotate in association with each other, whereby the mandrels can certainly rotate on the blankets and the rotation of the mandrels and the blankets can be precisely controlled by the simple structure.

(4) According to the multi-color printing apparatus for printing on a cylindrical body according to a fifth aspect of the present invention, since the rotation control mechanism is provided with the positioning mechanisms for causing the position where the outer peripheral surface of the cylindrical body on a mandrel comes into contact with that of an ink transfer blanket on the blanket cylinder for the first time to be unchanged with respect to the plurality of ink adhesion mechanisms at all times, an ink adhesion start position is set to each ink adhesion mechanism, whereby multi-color printing of high quality can be made possible.

(5) According to the multi-color printing apparatus for printing on a cylindrical body according to a sixth aspect of the present invention, since the positioning mechanism is provided with the intermediate gears coupled with the respective adjacent blanket side gears and the mandrel side gears rotate and move between the blanket side gears and the intermediate gears while maintaining the engaging relationship therewith, the mandrels can be certainly transferred on the next blanket cylinders without causing dislocation. Therefore, a plurality of colors of inks can be successively adhered by the simple structure onto a cylindrical body with pinpoint accuracy.

(6) According to the multi-color printing apparatus for printing on a cylindrical body according to a seventh aspect of the present invention, since the ink of a cylindrical body held by the mandrel of a mandrel side gear is dried when the mandrel side gear is coupled with an intermediate gear, the drying process can be carried out while the cylindrical body is transferred and rotated by the intermediate gear, whereby the ink can be easily dried over the entire periphery of the cylindrical body without affecting the ink adhesion process.

Obviously, numerous (additional) modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A method for performing multi-color printing on a cylindrical body, comprising the steps of:

adhering a first color of ink onto an outer peripheral surface of the cylindrical body, including, holding the cylindrical body on a mandrel by inserting said cylindrical body over said mandrel, applying to said cylindrical body the first color of ink from a blanket disposed about a blanket cylinder by, contacting at a contact portion the cylindrical body to the blanket which has said first color ink thereon, rotating the blanket and blanket cylinder in a predetermined direction about an axis of said blanket cylinder, rotating the mandrel and the cylindrical body in another direction opposite to said predetermined direction and about an axis of said mandrel, and moving said mandrel and said cylindrical body along an arc that follows a periphery of said blanket cylinder such that a relative motion is zero at said contact portion between said cylindrical body and said blanket;

drying the first color of ink; and repeating said adhering and drying steps for another color of ink applied by another blanket and another blanket cylinder.

2. A multi-color printing apparatus for printing on a cylindrical body, comprising:

a plurality of ink adhesion mechanisms configured to adhere different colors of ink onto an outer peripheral surface of the cylindrical body, respective of said plurality of ink adhesion mechanisms having a blanket cylinder and a blanket disposed around an outer periphery of the blanket cylinder, said blanket being configured to transfer one of the different colors of ink onto the cylindrical body by contacting the blanket to the cylindrical body at a contact position;

a cylindrical body moving mechanism configured to successively hold and move the cylindrical body to said plurality of ink adhesion mechanisms, including, a plurality of mandrels, each having an axis parallel with an axis of the blanket cylinder and each mandrel being configured to hold the cylindrical body thereon by inserting the cylindrical body over the mandrel, a plurality of mandrel moving mechanisms configured to move the cylindrical body and respective of the plurality of mandrels in an arc along the outer periphery of the blanket of a corresponding one of the plurality of ink adhesion mechanism so as to contact the cylindrical body with the blanket at said contact position, and a plurality of rotation control mechanisms each configured to rotate the blanket cylinder of a corresponding one of the plurality of ink adhesion mechanisms about an axis of the blanket cylinder in a direction opposite to a moving direction of the cylindrical body that is in contact with the blanket, and configured to rotate the mandrel about an axis of the mandrel so that a relative velocity of the cylindrical body and the blanket at the contact position is zero; and a plurality of ink drying mechanisms each configured to dry respective of said different colors of ink applied by one of the plurality of ink adhesion mechanisms directly upstream of respective of said plurality of ink drying mechanisms, where upstream is relative to a moving direction of said cylindrical body moving mechanism.

3. The multi-color printing apparatus according to claim 2, wherein said cylindrical body moving mechanism further comprises:

a wheel having the plurality of mandrels disposed along the outer periphery of the wheel; and a wheel driving mechanism configured to rotate said wheel about an axis of the wheel, wherein the blanket cylinders and the blankets of said plurality of ink adhesion mechanisms are disposed around the wheel at equal intervals in a peripheral direction thereof in parallel with the axis of the wheel, and said wheel driving mechanism is configured to rotate said wheel to successively move the plurality of mandrels to the respective contact positions with respective of the blankets.

4. The multi-color printing apparatus according to claim 2, wherein:

each of said plurality of rotation control mechanisms includes a mandrel side gear fixed to a shaft of the mandrel and coaxially aligned with the axis of the mandrel; and respective blanket side gears are fixed to respective shafts of the blanket cylinders and are coaxially aligned with respective axes of the blanket cylinders such that when the respective of the plurality of mandrels move in arcs along respective outer peripheries of respective of the blankets, the mandrel side gear is coupled with the blanket side gear.

5. The multi-color printing apparatus according to claim 3, wherein:

each of said plurality of rotation control mechanisms includes a mandrel side gear fixed to a shaft of the mandrel and coaxially aligned with the axis of the mandrel; and respective blanket side gears are fixed to respective shafts of the blanket cylinders and are coaxially aligned with respective axes of the blanket cylinders such that when the respective of the plurality of mandrels move in arcs along respective outer peripheries of respective of the blankets, the mandrel side gear is coupled with the blanket side gear.

6. The multi-color printing apparatus according to claim 4, wherein:

each of said rotation control mechanisms includes positioning means for causing the contact position to remain unchanged with respect to said plurality of ink adhesion mechanisms at all times when a first color ink of the different colors ink is applied by a first blanket of a first of said plurality of ink adhesion mechanisms.

7. The multi-color printing apparatus according to claim 5, wherein:

each of said rotation control mechanisms includes positioning means for causing the contact position to remain unchanged with respect to said plurality of ink adhesion mechanisms at all times when a first color ink of the different colors ink is applied by a first blanket of a first of said plurality of ink adhesion mechanisms.

8. The multi-color printing apparatus according to claim 6, wherein:

said positioning means includes an intermediate gear disposed between respective of adjacent of said ink adhesion mechanisms and coupled with the blanket side gear of each ink adhesion mechanism; and the mandrel side gear is coupled so as to rotate and move, while being engaged, between a corresponding one of the blanket side gears and the intermediate gear.

9. The multi-color printing apparatus according to claim 7, wherein:

said positioning means includes an intermediate gear disposed between respective of adjacent of said ink adhesion mechanisms and coupled with the blanket side gear of each ink adhesion mechanism; and the mandrel side gear is coupled so as to rotate and move, while being engaged, between a corresponding one of the blanket side gears and the intermediate gear.

10. The multi-color printing apparatus according to claim 6, wherein:

each of said plurality of ink drying mechanism is configured to dry one of the different colors of ink of the cylindrical body on the mandrel side gear when the mandrel side gear coupled with the intermediate gear.

11. The multi-color printing apparatus according to claim 7, wherein:

each of said plurality of ink drying mechanisms is configured to dry one of the different colors of ink of the cylindrical body on the mandrel side gear when the mandrel side gear coupled with the intermediate gear.

12. A multi-color printing apparatus for printing on a cylindrical body, comprising:

means for adhering a first color of ink onto an outer peripheral surface of the cylindrical body, including, a mandrel;

means for holding the cylindrical body on the mandrel, means for applying to said cylindrical body the first color of ink from a blanket of a blanket cylinder, including, means for contacting at a contact portion the cylindrical body to the blanket which has said first color ink thereon, means for rotating the blanket and the blanket cylinder in a predetermined direction about an axis of said blanket cylinder, means for rotating the mandrel and the cylindrical body in another direction opposite to said predetermined direction and about an axis of said mandrel, and means for moving said mandrel and said cylindrical body, along an arc that follows a periphery of said blanket cylinder such that a relative motion is zero at said contact portion between said cylindrical body and said blanket;

means for drying the first color of ink; and means for adhering and drying another color of ink applied by another blanket and another blanket cylinder to said cylindrical body.

13. An apparatus for applying different colors of ink to a cylindrical body, comprising:

a plurality of color application stations, each comprising means for applying a predetermined color of different colors of ink to a peripheral surface of said cylindrical body;

means for rotatably supporting said plurality of color application stations, having, a first member configured to rotate in a first direction about a first axis, first motive means for effecting a rotational motion of said first member about said first axis; and a plurality of mandrel housing means for moving respective of a plurality of mandrels attached thereto in a rotational movement about a housing means axis, wherein said means for rotatably supporting said plurality of color application stations includes second motive means associated with respective of said plurality of mandrel housing means for effecting a rotation movement of each of said mandrel housing means about the housing means axis, respective of said mandrel housing means includes a mandrel of said plurality of mandrels and means for rotating said mandrel about a mandrel axis, said mandrel axis being in a predetermined eccentric position in said mandrel housing means with respect to said mandrel housing axis such that the rotational movement of said mandrel housing means about the housing means axis effects an orbital motion of said mandrel relative to said housing means axis, said mandrel being configured to support the cylindrical body thereon for presentation to at least one of the plurality of color application stations, and said means for rotatably supporting includes third motive means in operative communication with respective of said mandrels for rotating respective of said mandrels about the mandrel axis at a predetermined rate of speed for at least a portion of each rotation of said mandrel housing means about said mandrel housing means axis when said mandrel is proximate at least one of said color application stations.

* * * * *